US008640305B2

(12) United States Patent
Pecar et al.

(10) Patent No.: US 8,640,305 B2
(45) Date of Patent: Feb. 4, 2014

(54) HINGE ASSEMBLIES

(75) Inventors: David Pecar, Koper (SI); Valter Svara, Izola (SI)

(73) Assignee: Lama D.D. Dekani, Dekani (SI)

( * ) Notice: Subject to any disclaimer, the term of this patent is extended or adjusted under 35 U.S.C. 154(b) by 0 days.

(21) Appl. No.: 13/265,367

(22) PCT Filed: Apr. 29, 2010

(86) PCT No.: PCT/IB2010/001200
§ 371 (c)(1),
(2), (4) Date: Oct. 20, 2011

(87) PCT Pub. No.: WO2010/133957
PCT Pub. Date: Nov. 25, 2010

(65) Prior Publication Data

US 2012/0036678 A1 Feb. 16, 2012

(30) Foreign Application Priority Data

Apr. 29, 2009 (GB) ..... 0907395.8

(51) Int. Cl.
*E05F 3/22* (2006.01)
*E05F 1/08* (2006.01)

(52) U.S. Cl.
USPC ..... 16/50; 16/286; 16/54

(58) Field of Classification Search
USPC ..... 16/286–289, 294, 54, 56, 366, 16/370–371, 354
See application file for complete search history.

(56) References Cited

U.S. PATENT DOCUMENTS

| | | | | |
|---|---|---|---|---|
| 2,078,815 | A * | 4/1937 | Segar | 16/286 |
| 2,940,116 | A * | 6/1960 | Salice | 16/291 |
| 3,362,042 | A * | 1/1968 | Salice | 16/278 |
| 5,269,043 | A * | 12/1993 | Yang | 16/68 |
| 6,591,454 | B2 * | 7/2003 | Brustle | 16/374 |
| 6,859,979 | B2 * | 3/2005 | Egger et al. | 16/327 |
| 7,065,833 | B2 * | 6/2006 | Kropf | 16/286 |
| 7,194,785 | B2 * | 3/2007 | Li | 16/85 |
| 7,395,580 | B2 * | 7/2008 | Brustle et al. | 16/50 |
| 7,562,416 | B2 * | 7/2009 | Lautenschlager et al. | 16/286 |
| 7,748,082 | B2 | 7/2010 | Harald et al. | |
| 2003/0200625 | A1 * | 10/2003 | Zimmer | 16/306 |
| 2005/0246863 | A1 * | 11/2005 | Chesworth et al. | 16/221 |
| 2009/0119875 | A1 | 5/2009 | Migli | |
| 2009/0119876 | A1 | 5/2009 | Pecar et al. | |
| 2010/0139041 | A1 | 6/2010 | Pecar et al. | |

FOREIGN PATENT DOCUMENTS

| | | | |
|---|---|---|---|
| DE | 10 2007 037 480 | A1 | 3/2008 |
| FR | 2751020 | A1 | 1/1998 |
| WO | WO 2006088435 | A2 * | 8/2006 |

* cited by examiner

*Primary Examiner* — Chuck Mah
(74) *Attorney, Agent, or Firm* — Alan Kamrath; Kamrath IP Lawfirm, P.A.

(57) ABSTRACT

A toggle type hinge (10) has a damper assembly mounted on the flange (12) of its hinge cup. The damper assembly provides a damping resistance to the closing movement of the hinge over its final stage. The damper assembly includes: a sleeve (21) which houses a linear damper. The sleeve (21) is mounted on a groove (26) on the hinge cup flange (12) and is held in position by a holder (15). A wing (22) on the sleeve (21) is arranged to come into engagement with an arm (11) of the hinge, causing the sleeve to rotate about its longitudinal axis (25). A cam arrangement (19, 23) between the hinge cup flange (12) and the sleeve (21) causes the sleeve to move along its axis (25) as it rotates. The axial movement of the sleeve (21) causes compression of the damper.

13 Claims, 2 Drawing Sheets

HINGE ASSEMBLIES

FIELD OF THE INVENTION

This invention relates to hinge assemblies, and more particularly, to assemblies comprising toggle type hinges, of the sort that are typically used on kitchen cupboards, together with a damping device.

SUMMARY OF THE INVENTION

The invention provides a hinge assembly comprising a toggle type hinge, a damper assembly comprising a linear damping device, and a holder. The damping device is arranged with its axis parallel to the axis of movement of the hinge and mounted between the holder and the cup flange of the hinge. The hinge assembly further comprises means for converting rotational movement of the hinge into linear movement of the damping device over at least part of the range of the rotational movement of the hinge. The movement converting means comprises a camming surface and a cam follower, one of which is provided on the damper assembly and the other of which is provided on the holder and/or on the hinge cup flange.

BRIEF DESCRIPTION OF THE DRAWINGS

By way of example, embodiments of the invention will now be described with reference to the accompanying drawings, in which.

DETAILED DESCRIPTION OF THE PREFERRED EMBODIMENTS

Figure 1:
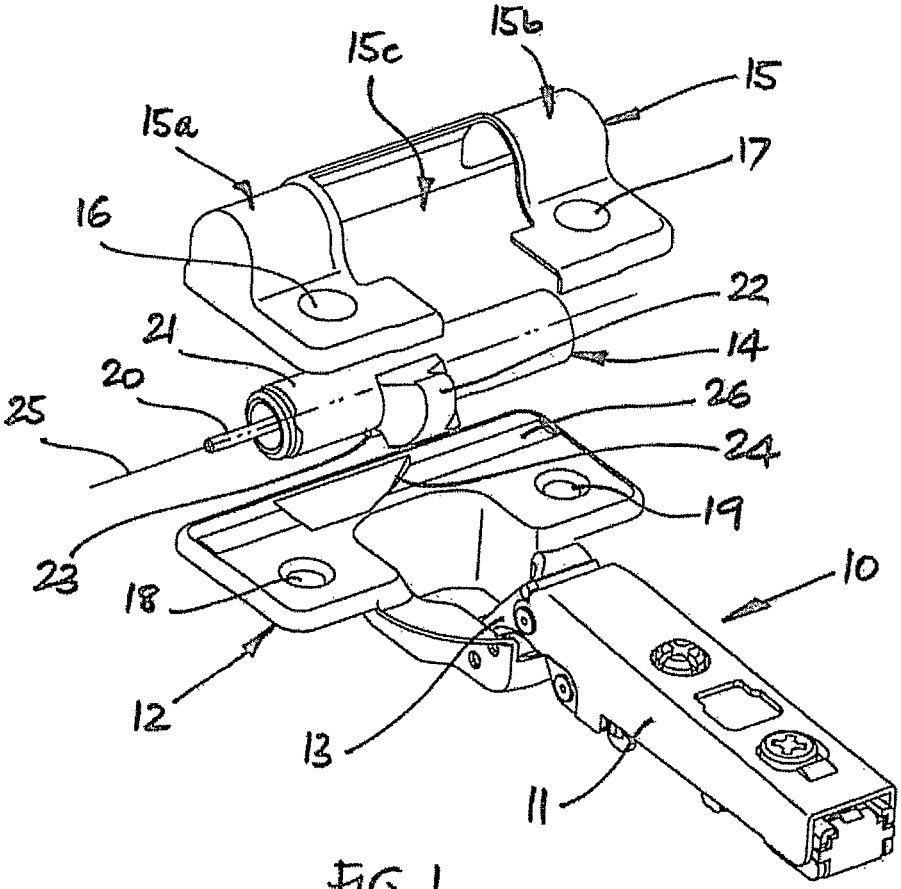
FIG. 1 is an exploded view of a hinge assembly according to the invention.
Figure 2:
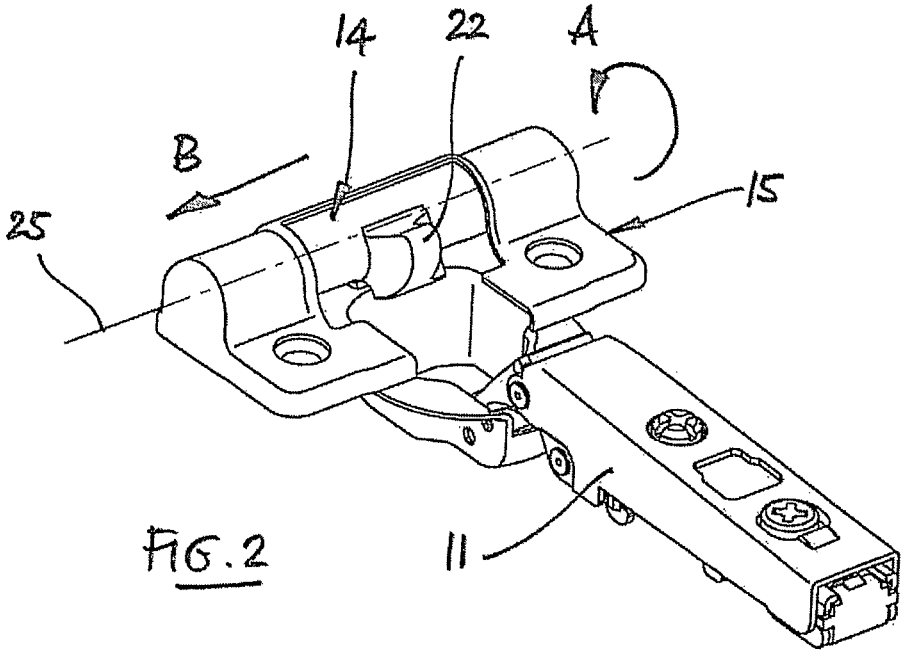
FIG. 2 shows the hinge assembly of FIG. 1 in its open position.
Figure 3:
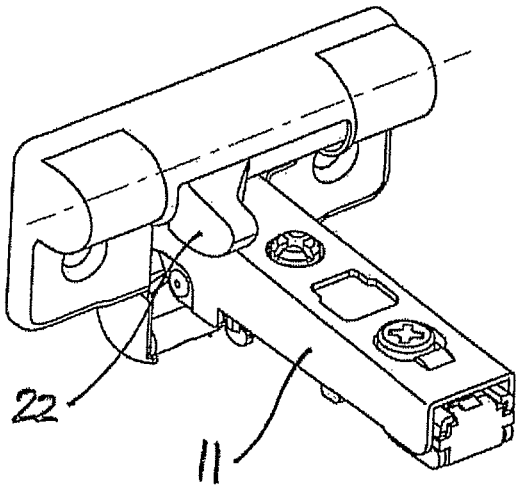
FIG. 3 shows the hinge assembly of FIG. 1 in its closed position.

The hinge assembly seen in the drawings comprises a hinge mechanism 10 which is essentially of the well known toggle-type construction for hanging a door, e.g. on a kitchen cupboard. The hinge mechanism 10 comprises an arm assembly 11, which is attachable to a door frame in known manner, and a hinge cup flange 12, which is attachable to a door in known manner. The hinge cup flange 12 is pivotably connected to the arm assembly 11 in known manner by means of a compound linkage 13.

The hinge assembly includes a damper assembly 14. Here, the damper assembly 14 comprises a conventionally known form of linear damper held within a sleeve 21. The linear damper has a piston 20 arranged for reciprocal movement in a damping medium contained within a cylinder (not seen), with an internal spring (not seen) normally biasing the piston towards its extended position. The damper assembly 14 is mounted on the hinge mechanism 10 to provide damped resistance to the closing movement of the hinge, at least over the final part of this movement, in known manner. A linear damper is preferred to a rotary damper for this purpose, because rotary dampers tend not to be capable of delivering sufficient damping power in arrangements of this kind.

The damper assembly 14 is mounted here directly onto the hinge cup flange 12. Specifically, the sleeve 21 is positioned on an elongate radiused groove 26 on the upper surface of the hinge cup flange 12. The groove 26 helps to locate the sleeve 21 and guide its movement. The sleeve 21 is held in position on the groove 26 by a holder 15, with the ends of the sleeve being journalled in respective end sections 15*a*, 15*b* of the holder. The arrangement is such as to allow both axial and rotational movement of the sleeve 21, as will be explained in more detail below.

The holder 15 is conveniently made out of pressed sheet metal and is shaped to fit over the hinge cup flange 12. A pair of holes 16, 17 in the holder 15 are designed to line up with mounting holes 18, 19 in the hinge cup flange 12, conveniently allowing both the holder and the hinge cup flange to be mounted together onto the door using the same fasteners. Alternative manners of mounting the holder 15 on the hinge cup flange 12 are of course possible, including for example the use of a snap-fit connection.

Extending out from the sleeve 21 is an actuating wing 22. The wing 22 is arranged to protrude through a cutaway section 15*c* in the mid portion of the holder 15, as will be seen in the drawings. The wing 22 is designed to come into engagement with the lower section of the arm assembly 11 towards the end of the closing movement of the hinge. The face of the wing 22 that engages the arm assembly 11 is contoured so that it acts as a cam. Specifically, as the arm assembly 11 approaches its closed position, its engagement with the wing 22 causes the sleeve 21 to rotate about its longitudinal axis 25.

In addition to its rotational movement, the sleeve 21 is also caused to move axially along the groove 26. The mechanism for causing this comprises a cam follower 23 (seen only partially in the drawings) on the sleeve 21, which is in engagement with a helically extending camming track 24 on the hinge cup flange 12. When the sleeve 21 is rotated by the action of the arm assembly 11 on the wing 22 (illustrated by arrow A in the drawings), the sleeve is caused to move along the groove 26 by the action of the cam follower 23 on the camming track 24 (illustrated by arrow B in the drawings). With the damper piston 20 being held against the end section 15*a* of the holder 15, and the damper cylinder being held within the sleeve 21, the net effect is to cause compression of the damper. Compression of the damper transmits a damping force back to the arm assembly 11 via the wing 22, thus resisting the closing movement of the hinge.

The helically extending camming track 24 is located centrally in this arrangement and formed on the hinge cup flange 12 itself. Neither are essential. The camming track could be formed to one side. Alternately, the camming track could be formed in two separate sections, one to either side. The camming track could alternatively or additionally be formed on the holder 15. If the camming track 24 is provided on the holder 15, this has the advantage that the damper assembly 14 can be fitted to a standard hinge or retro-fitted to an existing hinge with only minimal modification. For aesthetic reasons, however, it is preferred to form the camming track 24 on the hinge cup flange 12 as an integral part thereof. In either arrangement, the number of component parts of the hinge and damper assembly as a whole is able to be kept to a minimum.

The damper assembly 14 here is designed to accommodate a standard form of linear damper, with the wing and cam follower features being formed on the sleeve. An alternative option would be to provide instead a specially designed damper with the wing and cam follower features being formed as integral parts of it. This would have the advantage of minimising the number of component parts in the overall assembly, as well as facilitating the manufacturing process.

In the arrangement described above, the cam follower takes the form of a short section of a helical track, complementary to the camming track. However, the cam follower could instead take the form of a pin or the like. In this form, the cam follower would make essentially only point contact with the camming track. This would allow the possibility for varying the pitch of the camming track. Varying the pitch of the camming track would result in the damper assembly transmitting a variable damping force to the hinge, because the rate of movement of the damper with respect to the rate of rotation of the hinge would not be constant. Thus, for example, it could be arranged that the damping force to be transmitted to the hinge could progressively diminish over the course of the final closing movement of the hinge. It will be appreciated that the positioning of the pin and camming track may be arranged the opposite way round to that described above. It will further be appreciated that other arrangements might equally well be used for converting the rotational movement of the hinge to linear movement of the damper, as shown for example in earlier published application WO 2006/088435.

The invention claimed is:

1. A hinge assembly comprising:

a toggle type hinge for rotational movement about an axis of rotation and having a hinge cup flange and an arm assembly pivotably connected to the hinge cup flange about the axis of rotation, wherein the hinge cup flange and the arm assembly is adapted to be connected to first and second components hinged together by the toggle type hinge;

a holder;

a damper assembly mounted directly onto the hinge cup flange, with the damper assembly comprising a linear damping device operable along a linear axis, wherein the linear damping device is arranged with the linear axis parallel to the axis of rotational movement of the toggle type hinge and retained in the hinge cup flange by the holder; and means for converting the rotational movement of the toggle type hinge into operative movement of the damping device at least over part of a range of the rotational movement of the toggle type hinge, with the rotational movement converting means comprising a camming surface and a cam follower engaging with the camming surface, with one of the camming surface and the cam follower provided on the linear damper assembly and another of the camming surface and the cam follower provided on the holder and/or on the hinge cup flange, wherein the camming surface extends helically with respect to the linear axis of the damping device.

2. A hinge assembly as claimed in claim 1 wherein the hinge cup flange is provided with means for locating the damper assembly and for guiding operative movement of the damper assembly.

3. A hinge assembly as claimed in claim 1 wherein the cam follower takes a form of a pin making essentially only point contact with the camming surface.

4. A hinge assembly as claimed in claim 1 wherein the linear damping device comprises a proprietary piston and cylinder damper and the damper assembly comprises a sleeve for mounting said device.

5. A hinge assembly as claimed in claim 4 wherein the camming surface or the cam follower is provided on the sleeve.

6. A hinge assembly as claimed in claim 1 wherein the movement converting means further comprises a wing on the damper assembly arranged to engage the arm assembly of the toggle type hinge in use.

7. A hinge assembly as claimed in claim 6 wherein said wing is provided on the sleeve.

8. A hinge assembly as claimed in claim 1 wherein the linear damping device comprises a piston and cylinder type damper and the camming surface or cam follower is provided as an integral part of the device.

9. A hinge assembly as claimed in claim 8 wherein the wing is provided as an integral part of the damping device.

10. A piece of furniture incorporating a hinge assembly as claimed in claim 1.

11. A hinge assembly comprising:

a toggle type hinge having a hinge cup flange;

a damper assembly comprising a linear damping device;

a holder, wherein the linear damping device is arranged with an axis parallel to an axis of rotational movement of the toggle type hinge and mounted between the holder and the hinge cup flange; and means for converting the rotational movement of the toggle type hinge into operative movement of the linear damping device at least over part of a range of the rotational movement of the toggle type hinge, with the rotational movement converting means comprising a camming surface and a cam follower engaging with the camming surface, with one of the camming surface and the cam follower provided on the linear damper assembly and another of the camming surface and the cam follower provided on the holder and/or on the hinge cup flange, wherein the hinge cup flange comprises an elongate radiused groove for locating and guiding movement of the linear damping device.

12. A hinge assembly comprising:

a toggle type hinge having a hinge cup flange;

a damper assembly comprising a linear damping device;

a holder, wherein the linear damping device is arranged with an axis parallel to an axis of rotational movement of the toggle type hinge and mounted between the holder and the cup flange of the hinge; and means for converting the rotational movement of the toggle type hinge into operative movement of the linear damping device at least over part of a range of the rotational movement of the toggle type hinge, with the rotational movement converting means comprising a camming surface and a cam follower engaging with the camming surface, with one of the camming surface and the cam follower provided on the linear damper assembly and another of the camming surface and the cam follower provided on the holder and/or on the hinge cup flange, wherein the camming surface is provided on the hinge cup flange as an integral part thereof.

13. A hinge assembly comprising:

a toggle type hinge having a hinge cup flange;

a damper assembly comprising a linear damping device;

a holder, wherein the linear damping device is arranged with an axis parallel to an axis of rotational movement of the toggle type hinge and mounted between the holder and the hinge cup flange of the hinge; and means for converting the rotational movement of the toggle type hinge into operative movement of the linear damping device at least over part of a range of the rotational movement of the toggle type hinge, with the rotational movement converting means comprising a camming surface and a cam follower engaging with the camming surface, with one of the camming surface and the cam follower provided on the linear damper assembly and another of the camming surface and the cam follower provided on the holder and/or on the hinge cup flange, wherein the cam follower takes a form of a pin making essentially only point contact with the camming surface, wherein a pitch of the camming surface is variable.

* * * * *